US010934701B2

(12) United States Patent
Pfaff

(10) Patent No.: US 10,934,701 B2
(45) Date of Patent: Mar. 2, 2021

(54) POSITIONING DEVICE AND METHOD FOR PRODUCING A REINFORCED CONSTRUCTION MATERIAL BODY

(71) Applicant: Solidian GmbH, Albstadt (DE)

(72) Inventor: Johann Pfaff, Winterlingen (DE)

(73) Assignee: Solidian GmbH, Albstadt (DE)

( * ) Notice: Subject to any disclaimer, the term of this patent is extended or adjusted under 35 U.S.C. 154(b) by 0 days.

(21) Appl. No.: 16/357,711

(22) Filed: Mar. 19, 2019

(65) Prior Publication Data

US 2019/0292767 A1 Sep. 26, 2019

(30) Foreign Application Priority Data

Mar. 20, 2018 (EP) ..... 18162869

(51) Int. Cl.
*E04B 1/16* (2006.01)
*E04B 1/24* (2006.01)
(Continued)

(52) U.S. Cl.
CPC ..... *E04B 1/165* (2013.01); *B28B 23/024* (2013.01); *E04B 1/2403* (2013.01); *E04B 2/86* (2013.01);
(Continued)

(58) Field of Classification Search
CPC ..... B28B 23/024; B28B 1/084; B28B 3/228; E04B 1/165; E04G 21/12; E04G 21/185
See application file for complete search history.

(56) References Cited

U.S. PATENT DOCUMENTS 2,596,206 A 5/1952 Carnes
3,068,766 A 12/1962 Houck
6,711,866 B2 * 3/2004 Blount ..... B28B 23/024 52/125.5

FOREIGN PATENT DOCUMENTS

DE 1177537 B 9/1964
DE 3312396 C2 * 6/1986 ..... B28B 21/56
(Continued)

OTHER PUBLICATIONS

Extended European Search Report dated Apr. 26, 2018, for European Application No. 18162869.4 (9 pages).

*Primary Examiner* — Babajide A Demuren
(74) *Attorney, Agent, or Firm* — Fitch, Even, Tabin & Flannery LLP

(57) ABSTRACT

A positioning device and method for producing a construction material body. The positioning device holds and orients a reinforcement body consisting of a textile reinforcement within a formwork. The positioning device comprises first and second holding part groups arranged on a main body. At least one of the two holding part groups is movable between holding and release positions. In the holding position, each holding part acts on an associated location of engagement on the reinforcement body. In the release position, the distance between the holding parts is different from the distance between the locations of engagement on the reinforcement body, such that the positioning device is brought into engagement with the reinforcement body or can be removed therefrom. In the release position, independent handling of the positioning device relative to the reinforcement body is possible. To switch between the holding and release positions, an actuation device is provided.

19 Claims, 5 Drawing Sheets

(51) Int. Cl.

| | |
|---|---|
| ***E04B 2/86*** | (2006.01) |
| ***E04G 21/12*** | (2006.01) |
| ***B28B 23/02*** | (2006.01) |
| ***E04G 21/18*** | (2006.01) |

(52) U.S. Cl.
CPC ..... *E04G 21/12* (2013.01); *E04G 21/185* (2013.01); *E04B 2001/2415* (2013.01); *E04B 2001/2424* (2013.01); *E04B 2001/2445* (2013.01); *E04B 2001/2457* (2013.01)

(56) References Cited

FOREIGN PATENT DOCUMENTS

| | | | | | |
|---|---|---|---|---|---|
| DE | 3536841 | A1 * | 6/1986 | ..... | E04C 5/16 |
| FR | 1332879 | A * | 7/1963 | ..... | B28B 11/145 |
| GB | 966933 | A | 8/1964 | | |
| WO | WO-2014108535 | A1 * | 7/2014 | | |

* cited by examiner

POSITIONING DEVICE AND METHOD FOR PRODUCING A REINFORCED CONSTRUCTION MATERIAL BODY

RELATED APPLICATION(S)

This application claims the benefit of European Patent Application No. 18162869.4, filed Mar. 20, 2018, the contents of which are incorporated herein by reference as if fully rewritten herein.

TECHNICAL FIELD

The invention relates to a positioning device and a method for producing a construction material body provided with a reinforcement with use of the positioning device.

BACKGROUND

In order to introduce a reinforcement body into a construction material body, spacers are nowadays arranged on the reinforcement before the reinforcement body is inserted into a formwork. The spacers define the distance of the reinforcement from an inner surface of the formwork. Flowable construction material, for example concrete or mortar, is then poured into the formwork, such that the reinforcement is covered. Once hardened, the construction material body can be stripped of the formwork. A disadvantage of this method is that the spacers are noticeable on the visible side of the construction material body since they abut against the formwork from the inside at these points and no construction material can infiltrate between the formwork and the spacers.

The object of the present invention can therefore be considered that of enabling simple positioning of a reinforcement body in a formwork without detriment to the visible side of the produced construction material body.

SUMMARY

This object is achieved by means of a positioning device and by means of a method as disclosed and described herein.

The positioning device according to the invention is configured to position a reinforcement body comprising reinforcement elements that cross one another in a formwork. The reinforcement body can be formed for example as a reinforcement grid which extends substantially in one plane.

The reinforcement body is preferably embodied as a textile reinforcement and comprises fibre bundles, wherein the fibres of a fibre bundle are connected by a matrix, in particular made of plastic or of mineral material. The reinforcement body is preferably free from metal constituents.

The positioning device has a main body, on which a first holding part group and a second holding part group are arranged. The two holding part groups are arranged at a distance from one another in a first spatial direction. Each holding part group comprises at least one holding part. If a holding part group has a number of holding parts, these are arranged at a distance from one another, in particular in a second spatial direction at right angles to the first spatial direction. The at least one holding part of the first holding part group is mounted movably in such a way that is movable between a holding position and a release position by the actuation of at least one actuation device. The movement may be a linear movement and/or pivot movement. The distance of the holding part of the first holding part group from the at least one holding part of the second holding part group is preferably greater in the holding position than in the release position.

The holding parts of the first and second holding part group are configured, in the holding position, to each act on an associated location of engagement on one of the reinforcement elements of the reinforcement body. The reinforcement body is thus held at the holding elements and can be moved, arranged and/or oriented collectively with the positioning device. For example, the positioning device can be arranged on the formwork by suitable means, such that the reinforcement body is arranged within the formwork in the desired position and orientation.

In the release position of the at least one holding part of the first holding part group, the reinforcement body is released by the holding parts. In the release position it is possible to handle the positioning device without influencing the position or orientation of the reinforcement body. The positioning device can therefore be removed from the reinforcement body or can be connected to the reinforcement body in the release position of the first holding part group.

The positioning device therefore offers a simple possibility for arranging a reinforcement body within the formwork without use of spacers. In particular, no spacers or parts of the reinforcement body abut against the inner surface of the formwork associated with the later visible side of the construction material body. The holding parts or the holding part groups are disposed in the region of the upwardly open side of the formwork and for example protrude upwardly from a flowable construction material poured into the formwork. By moving at least the first holding part group into the release position, the positioning device can be removed already before the construction material hardens. The position of the reinforcement body is maintained. Alternatively, the holding elements can also each have a predetermined breaking point and are severed at the predetermined breaking point once the construction material has hardened. The positioning device is then removed once the construction material has hardened. The holding parts visible from outside are then disposed on the rear side of the produced construction material body, opposite the visible side, and do not impair the appearance of the visible side.

It is advantageous if the holding parts of the first and the second holding part group are configured to generate a tensile force on the reinforcement body in the holding position between the locations of engagement. In particular, a textile reinforcement body can thus be held in a stretched position. This tensile force can be reduced by a switchover movement of at least the first holding part group into the release position.

The holding parts of both holding part groups are preferably arranged in such a way that the locations of engagement in the holding position are arranged in a common plane.

A contact face is preferably provided on the main body and is configured to be placed on an upper side of a formwork. For example, the main body can comprise one or more bar-shaped parts, the dimensions of which are sufficiently large for the main body to be placed on the edge of an upwardly open formwork.

It is additionally advantageous if the common plane in which the holding parts of the two holding part groups are arranged in the holding position is oriented in a predefined alignment or orientation relative to the contact face. For example, the common plane may be oriented parallel to the contact face. For example, a reinforcement body formed by a reinforcement grid can thus be positioned very easily in the formwork parallel to the contact face and for example horizontally. Alternatively, it is also possible for example to orient a reinforcement grid in the formwork in a defined inclination relative to the horizontal. To this end, the holding parts of one holding part group for example can be arranged very easily relative to the holding parts of the other holding part group with different distances from the contact face.

In a preferred embodiment adjustment means are provided which are configured to adjust the distance between holding parts and the contact face. The positioning device can thus be adapted in a versatile manner to different applications.

In one embodiment the holding parts of the second holding part group can be arranged on the main body so as to be immovable by the actuation device. The holding parts of the second holding part group remain unchanged relative to the main body when switching between the holding position and the release position, irrespective of the actuation of the actuation device. The structural design of the positioning device is thus simplified.

In another embodiment the holding parts of both holding part groups can be mounted on the main body so as to be movable by the actuation device. When switching from the holding position into the release position, the holding parts of both holding part groups therefore move relative to the main body. In this embodiment the removal of the positioning device from the reinforcement body without changing the position thereof in the construction material can be simplified.

It is advantageous if the positioning device comprises a pre-tensioning device. The pre-tensioning device is configured to pre-tension in the holding position the holding parts that are movable by the actuation device. In the unactuated state of the actuation device, the holding parts therefore assume the holding position. As a result of the actuation of the actuation device, the holding parts are moved into the release position against a pre-tensioning force generated by the pre-tensioning device.

The holding position is preferably defined by a stop that is associated with the first holding part group. Optionally, the release position can also be defined by a stop associated with the first holding part group.

It is also advantageous if a plurality of or all holding parts of a common first holding part group are arranged on a common support. The support is in turn movable by the actuation device. The support with the holding parts is therefore mounted movably on the main body.

The actuation device may comprise a handle for manual actuation. Additionally or alternatively, the actuation device may also comprise a drive part that can be motor-driven. An automated switchover between the holding position and the release position can be implemented by means of a drive part that can be motor-driven.

In order to be able to position larger reinforcement bodies, the positioning device may comprise in each case a plurality of first holding part groups and a plurality of second holding part groups. Each first holding part group and second holding part group preferably forms a pair. The number of such pairs can be selected depending on the reinforcement body to be positioned.

In one variant, each holding element may comprise a predetermined breaking point. This embodiment is advantageous if the positioning device remains on the formwork until the construction material has hardened. The holding parts are then fixed in the construction material and are severed at the predetermined breaking point in order to remove the positioning device.

In one embodiment the holding parts are formed by hooks. The hooks of the first holding part group and the hooks of the associated second holding part group are opened on the sides facing away from one another and are closed on the sides facing one another.

A construction material body can be produced by means of any of the above-explained embodiments of the positioning device as follows:

Firstly, the at least one holding part of the first holding part group is moved into the release position by means of the actuation device. The holding parts are then arranged adjacently to or on the respective location of engagement on the reinforcement body, and the holding parts of the first holding part group are moved into the holding position. In this position the reinforcement body is held by the holding parts on the positioning device and can be handled jointly with the positioning device.

The positioning device is arranged on the formwork. For example, the positioning device can be placed on the edge of the formwork by means of a contact face of the main body. The reinforcement body is then arranged in the formwork, preferably without having direct contact with an inner wall of the formwork. At least no parts of the reinforcement body are positioned at the later visible side of the construction material body. A flowable construction material is then poured into the formwork. For example, a mortar or a concrete can be used as construction material. The construction material is hardened in the formwork in order to produce the construction material body.

In a variant of the method the positioning device can be removed before the construction material hardens. To this end, the at least one holding part of the first holding part group is moved into the release position by means of the actuation device. The holding parts release the reinforcement body and the positioning device can be removed. The reinforcement body, in particular a textile reinforcement body, remains in the desired position and orientation within the formwork in the construction material that is still hardening.

Alternatively, the positioning device can remain on the formwork until the construction material has hardened. The holding parts are then severed, preferably in each case at a predetermined breaking point, and the positioning device can then be removed. In this variant of the method the holding elements are preferably made of plastic.

BRIEF DESCRIPTION OF THE DRAWINGS

Advantageous embodiments of the method will become clear from the dependent claims, the description, and the drawings. Preferred exemplary embodiments of the invention will be explained in greater detail hereinafter with reference to the accompanying drawings, in which:

DETAILED DESCRIPTION

Figure 1:
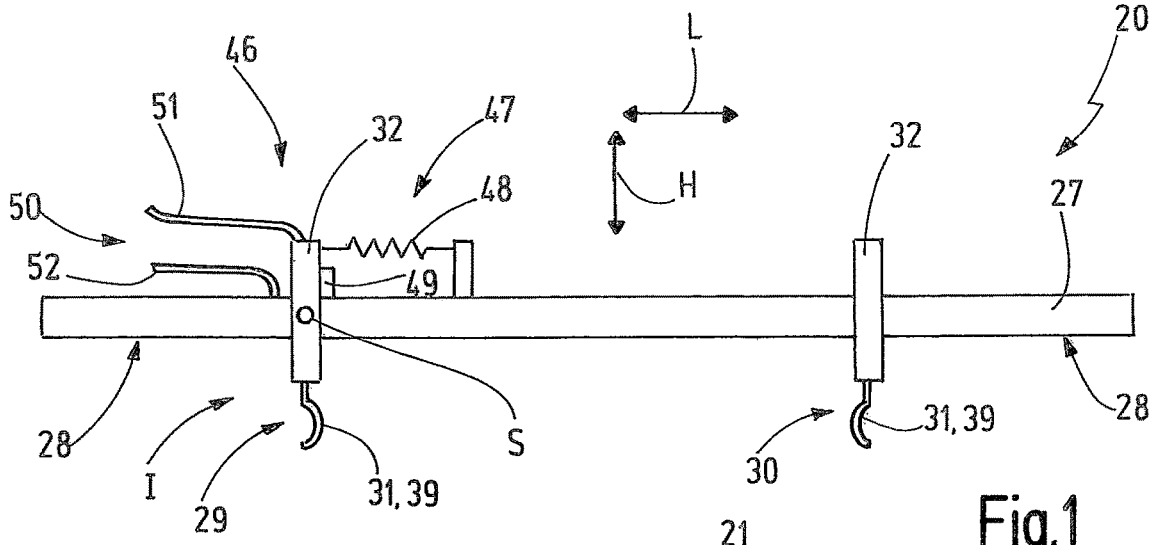
FIG. 1 shows a schematic side view of an exemplary embodiment of a positioning device.
Figure 2:
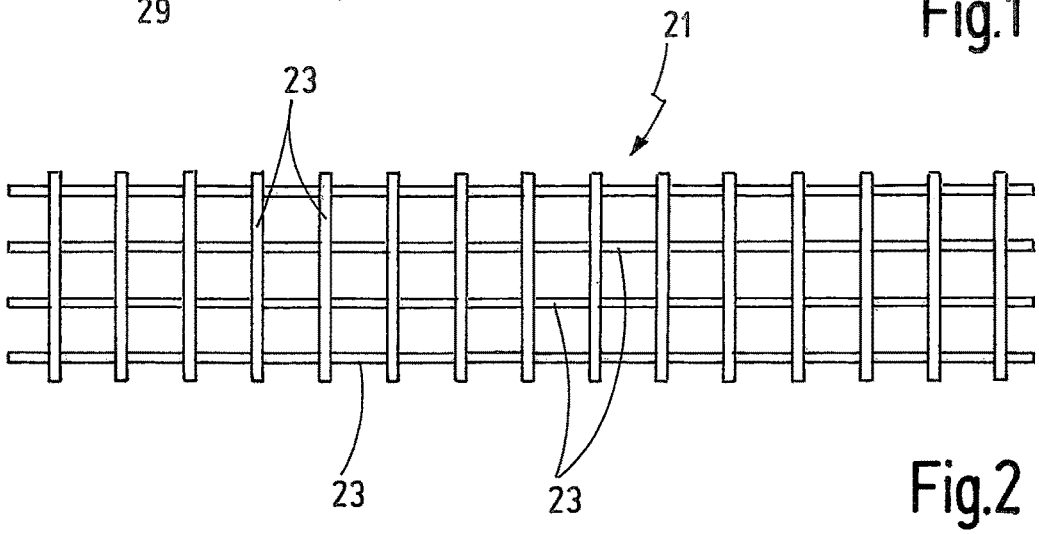
FIG. 2 shows a schematic plan view of a reinforcement body in the form of a reinforcement grid.
Figure 3:
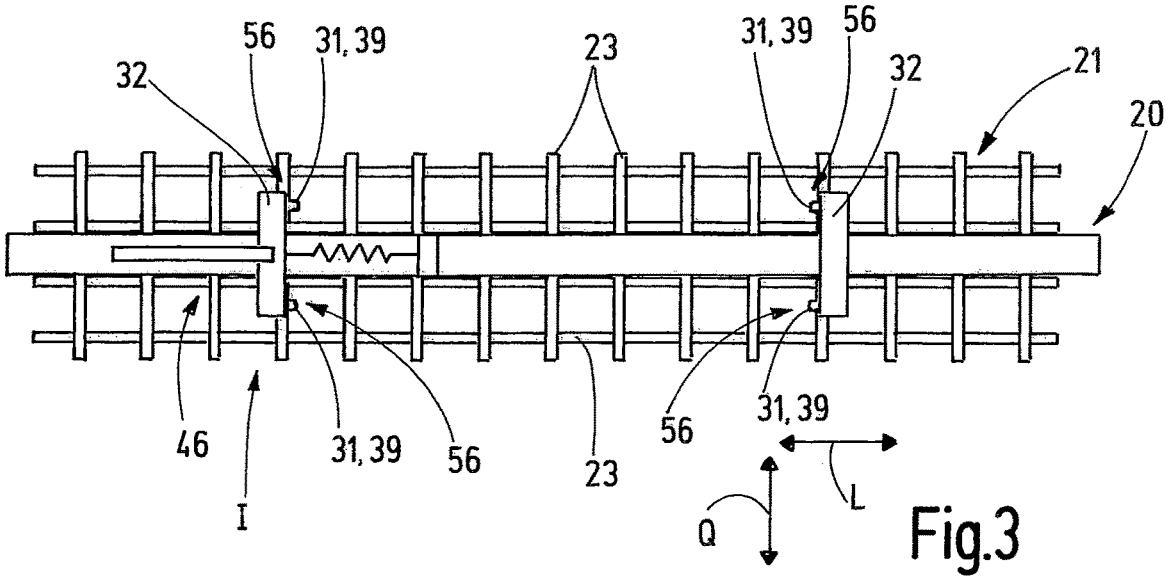
FIG. 3 shows a plan view of the reinforcement grid from FIG. 2 held by the positioning device from FIG. 1.

FIG. 1 shows an exemplary embodiment of a positioning device 20. The positioning device 20 is configured to receive and to hold a reinforcement body 21 (FIG. 2) and to arrange or orient said reinforcement body jointly with the positioning device 20, for example on a formwork 22 (see FIGS. 4-7).

The reinforcement body 21 has a plurality of reinforcement elements 23 which are connected to one another and cross one another. Reinforcement elements 22 in accordance with the example are each formed by a fibre bundle formed from multiple fibres (what are known as rovings), which are arranged in a plastics matrix or mineral matrix. As a result of the hardening of the matrix, the reinforcement elements 23 form bars which in particular can take up a tensile force in order to reinforce a construction material body that is to be produced. The reinforcement elements 23 are connected to one another at connection or cross locations and thus form the reinforcement body 21.

In the exemplary embodiment shown here, the reinforcement body 21 is a reinforcement grid which extends substantially in one plane and which can also be referred to as a reinforcement mat. In contrast hereto, other arbitrary two-dimensional or three-dimensional reinforcement structures can also be provided, such that the reinforcement body 21 can have any form. In principle, it can assume any form that can be produced by means of the reinforcement elements 23.

The reinforcement body 21 in accordance with the example is formed as a textile reinforcement body and is free from metal parts. In the illustration, the individual fibre bundles incorporated in the textile matrix each extend in a straight line in a single spatial direction. Depending on the form of the reinforcement body 21, the fibre bundles could also extend in portions in a straight line with bending or kink locations arranged therebetween.

The reinforcement body 21 must be positioned and oriented within the formwork 22 such that it can be surrounded by a construction material B (FIGS. 4-7) poured into the formwork and can thus assume the predefined position and orientation in the construction body to be produced. In order to arrange the reinforcement body 21 in position, spacers were previously used which were attached to the reinforcement body 21 and supported this in the desired position and orientation within the formwork 22. As a result of the use of the positioning device 20, it is possible to dispense with spacers of this kind for the positioning of the reinforcement body 21 within the formwork 22.

The positioning device 20 has a main body 27. In accordance with the example the main body a has a contact face 28 on an underside, which contact face is configured to be placed on the formwork 22 and—as is shown for example in FIGS. 4-7—on an upper edge of the formwork 22. The contact face 28 may be divided on the main body 27 into a number of separate face portions. In the exemplary embodiment the main body 27 extends in a first spatial direction, referred to as the longitudinal direction L, and at each of its opposite longitudinal end regions has a portion of the contact face 28. Each portion of the contact face is associated with an end face of a wall of the formwork 22.

The main body 27 is bar-shaped and preferably has an underside that is flat or that extends in one plane in order to form the contact face 28. For example, the bar-shaped main body 27 may have a polygonal and in particular rectangular cross-section.

At least two holding part groups 29, 30 each having at least one holding part 31 are arranged on the main body 27 of the positioning device 20. In the first exemplary embodiment of the positioning device 20 according to FIGS. 1-7, precisely one first holding part group 29 and precisely one second holding part group 30 are provided. As will also be explained with reference to other exemplary embodiments, a plurality of first holding part groups 29 and a plurality of second holding part groups 30 can also be provided, in particular a plurality of pairs each comprising precisely one first and one second holding part group 29, 30. The first holding part group 29 and the second holding part group 30 are arranged on the main body 27 at a distance from one another in the longitudinal direction L.

Both holding part groups 29, 30 in the first exemplary embodiment of the positioning device 20 each have a plurality of holding parts 31, and in accordance with the example two such holding parts. The holding parts 31 of the same holding part group 29 or 30 are preferably arranged in a second spatial direction, which is referred to as the transverse direction Q and is oriented at right angles to the longitudinal direction L, at a distance from one another and in accordance with the example in line with one another. The distances between the holding part groups 29, 30 in the longitudinal direction L and/or the number and distances of the holding parts 31 of a single holding part group 29 or 30 are defined depending on the dimension of the reinforcement body 21 to be held. As can be seen by way of example in FIGS. 2 and 3, the reinforcement grid forming the reinforcement body 21 is relatively short in the transverse direction Q, such that in accordance with the example two holding parts 31 are sufficient per holding part group 29, 30. With larger dimensions in the transverse direction Q, 3, 4 or more holding parts 31 can also be used in each holding part group 29, 30.

The holding parts 31 are arranged beneath the main body 27 and in accordance with the example beneath the contact face 28 in a third spatial direction, which is referred to as the vertical direction H and which is oriented at right angles to the longitudinal direction L and at right angles to the transverse direction Q.

Figure 11:
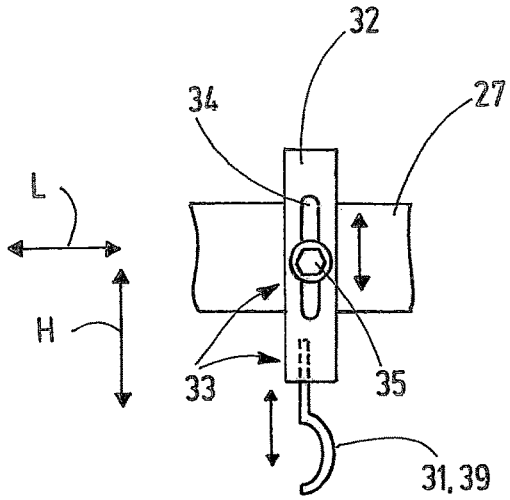
FIG. 11 shows a schematic depiction of adjustment means for adjusting a holding part of a positioning device.

The holding parts 31 of a common holding part group 29 are arranged on the main body 27 via at least one support 32. The positioning device 20 can comprise at least one adjustment means 33 in order to vary and adjust the distance between one of the holding parts 31 and the main body 27 and in accordance with the example in particular the contact face 28. The adjustment means 33 for this purpose may comprise a connection, displaceable in the vertical direction H, between the support 32 and the holding part 31 and/or between the support 32 and the main body 27, as is shown by way of example in FIG. 11. For example, a slot 34 extending in the vertical direction H can be provided in the support 32, through which slot a bolt 35 protrudes and fastens or movably mounts the support 32 on the main body 27. The support 32 can be displaced relative to the bolt 35 or the main body 27 along the slot 34 and can thus vary the vertical position of the holding part 31. Additionally or alternatively, the adjustment means 33 can comprise a screw connection between the holding part 31 and the support 32, such that the position of the holding part 31 relative to the main body 27 can be changed and adjusted by screwing the holding part 31 into the support 32 or unscrewing said holding part from the support 32 in the vertical direction H. It goes without saying that other adjustment means 33 can also be used alternatively to the explained adjustment means 33.

A plurality of or all holding parts 31 are preferably positionable in the vertical position in the vertical direction H relative to the main body 27 and are fixable in the desired vertical position by means of an associated adjustment means 33.

Figure 12:
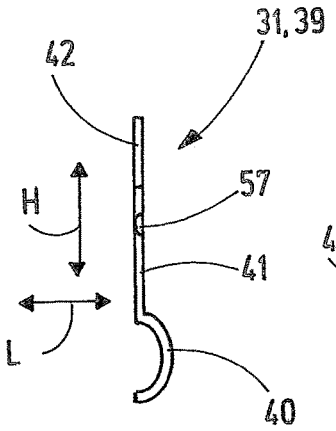
FIG. 12 shows an exemplary embodiment of a holding part of the positioning device with a predetermined breaking point.

In the exemplary embodiments shown here each holding part 31 is formed by a hook 39. Each hook 39 has a working portion 40 extending in a curved manner around a hook inner region and an attachment portion 41 adjoining the working portion (FIG. 12). The attachment portion 41 is formed in accordance with the example by a straight pin or bolt, at the free end of which, which is opposite the working portion 40, a fastening means and in accordance with the example an external thread 42 is provided. The hook 39 can be fastened to the support 32 by means of the external thread 42. The attachment portion 41 can alternatively also comprise other fastening means in order to arrange the hook 39 on the support 32.

In the first exemplary embodiment of the positioning device 20, the hooks 39 are oriented in such a way that the working portion curves around at least one axis extending substantially parallel to the transverse direction Q. The hooks 39 are open on one side in the longitudinal direction L. The hooks 39 of the first holding part group 29 are oriented such that the openings of the hook in regions of the curved working portions 40 face away from the hooks 39 of the second holding part group 30. Accordingly, the openings of the inner regions of the curved working portions 40 of the hooks 39 of the second holding part group 30 face away from the first holding part group 29.

Two or more planes that are spanned in each case by the longitudinal direction L and the vertical direction H preferably exist, wherein a holding part 31 or hook 39 of the first holding part group 29 and a holding part 31 or hook 39 of the second holding part group 30 are arranged in each plane.

Figure 5:
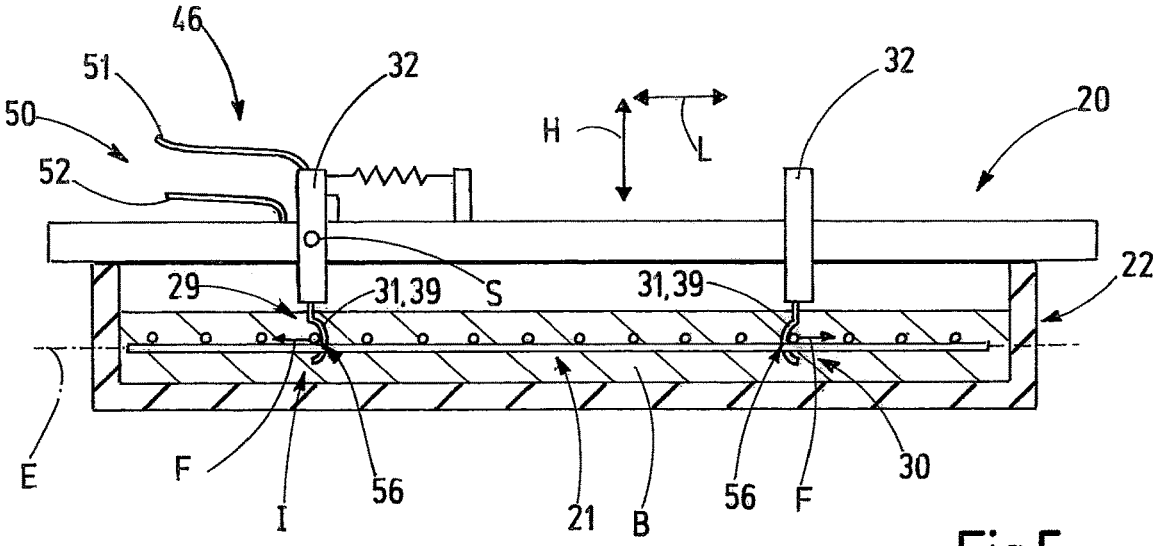
Figure 6:
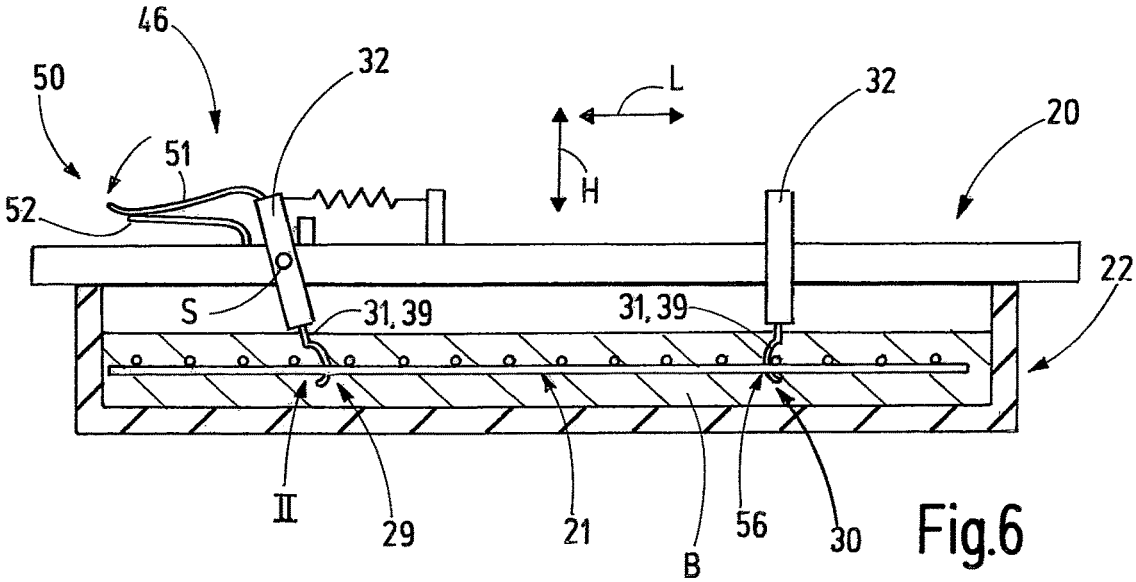
Figure 7:
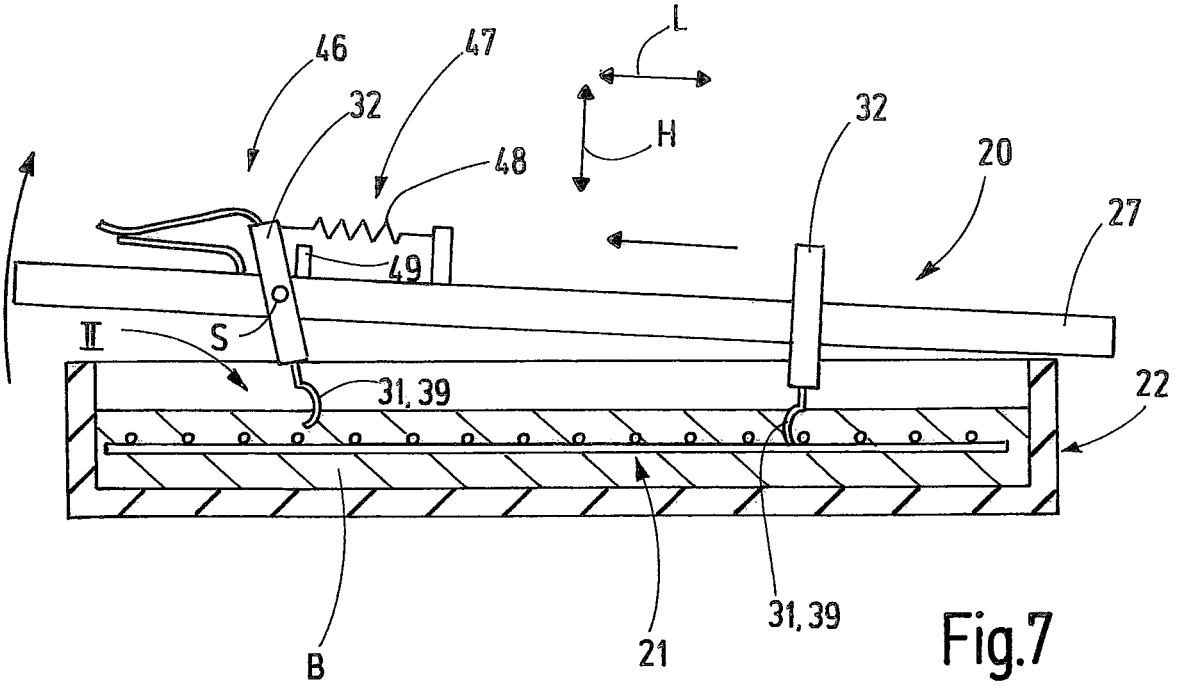

The holding parts 31 and in accordance with the example the hooks 39 of the first holding part group 29 are movable by an actuation device 46 between a holding position I (FIGS. 1 and 3-5) and a release position II (FIGS. 6 and 7). To this end, the holding parts 31 of the first holding part group 29 are fastened to a common support 32, wherein the support 32 is mounted on the main body 27 so as to be movable by means of the actuation device 46, and in accordance with the example pivotable about a pivot axis S extending in the transverse direction Q. The holding parts 31 of the first holding part group 29 can thus be moved relative to the main body during the pivoting about the pivot axis S. Here, the distance in the longitudinal direction L between the holding parts 31 of the two associated holding part groups 29, 30 of a pair changes. In the release position II, the distance between the holding parts 31 of the first holding part group and the second holding part group 29, 30 is smaller than in the holding position I.

The holding parts 31 or hooks 39 of the first holding part group 29 are pre-tensioned in the holding position I by means of a pre-tensioning device 47. The pre-tensioning device 47 for this purpose comprises at least one pre-tensioning element, in accordance with the example a spring 48 which applies a pre-tensioning force to the holding parts 31 and in accordance with the example the common support 32. By means of the pre-tensioning force, the support 32 is forced against a first stop 49, such that the position of the support 32 about the pivot axis S in the holding position I is defined or at least limited.

The pre-tensioning force can act as a tensile force and/or compressive force on the support 32. In the exemplary embodiment the pre-tension force is a tensile force that is generated by a coil spring. The spring 48 in accordance with the example engages with the support 32 at a distance from the pivot axis S and therefore generates a torque about the pivot axis S which forces the support 32 against the first stop 49.

The actuation device 46 and/or the pre-tensioning device 47 are preferably arranged on the top of the main body 27 or thereabove.

The actuation device 46 is configured for manual actuation in the first exemplary embodiment according to FIGS. 1-7 and for this purpose comprises a handle 50. The handle 50 has a first grip part 51 and a second grip part 52. The second grip part 52 is fixedly connected to the main body 27 and in accordance with the example is arranged below the first grip part 51 in the vertical direction H. The first grip part 51 is arranged on the support 32 at a distance from the pivot axis S and protrudes away from the support 32 in a direction that is oriented parallel to a radial plane through the pivot axis S. By pressing on the first grip part 51 in the vertical direction H, a torque can therefore be effected about the pivot axis S. The first grip part 51, in order to move the holding parts 31 of the first holding part group 29 into the release position II, can be moved in the vertical direction H towards the second grip part 52, such that the support 32 pivots about the pivot axis S against the pre-tensioning force. Here, the second grip part 52 is used as a further, second stop, which defines the release position II by limiting the pivot position of the support 32.

The distance between the two grip parts 51, 52, in an exemplary embodiment not shown in greater detail, can be adjustable in order to adjust the position of the holding parts 31 in the release position II. To this end, the position of the first grip part 51 and/or of the second grip part 52 in the vertical direction H can be variable or adjustable.

The above-described first exemplary embodiment of the positioning device 20 is used in the production of a reinforced and in particular textile-reinforced construction material body as follows:

The reinforcement body 21 is gripped and held by the holding parts 31 of the positioning device 20, such that common handling of the reinforcement body 21 with the positioning device 20 is possible. For this purpose, the holding parts 31 of the first holding part group 29 are moved into the release position II, such that the holding parts 31 can be moved through meshes between the reinforcement elements 23 of the reinforcement body 21. By subsequent movement of the holding parts 31 into the holding position I, the holding parts 31 of both holding part groups 29, 30 act in each case on a location of engagement 56 on the associated reinforcement element 23 of the reinforcement body 21. In the exemplary embodiment described here, a tensile force F is thus exerted onto the reinforcement body 21 in the longitudinal direction L between the locations of engagement 56 (FIGS. 4 and 5).

Figure 4:
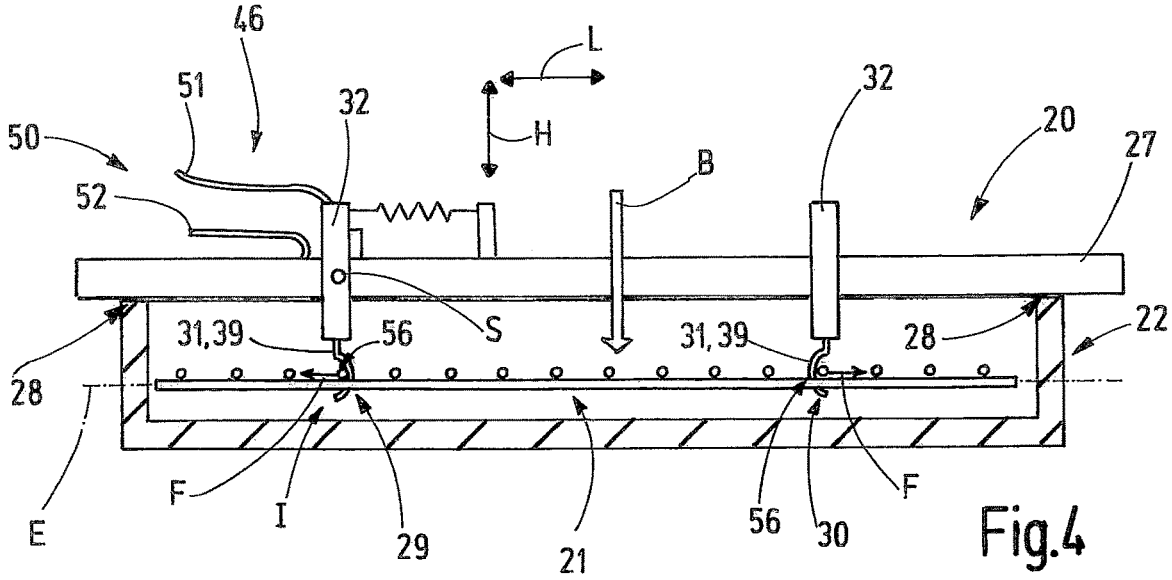
FIGS. 4 to 7 each show a schematic, partially sectional side view of different stages during the positioning of the reinforcement grid from FIGS. 2 and 3 by means of the positioning device from FIG. 1 in a formwork when producing a construction material body.

The reinforcement body 21 can be arranged jointly with the positioning device 20 on the formwork 22 (FIG. 4). To this end the positioning device 20 is placed by means of the contact face 28 on the upper edge of the formwork 22. The reinforcement body 21 is thus disposed within the formwork 22. The reinforcement body 21 in particular is not in contact with the base-side inner surface of the formwork 22, by which the later visible side of the produced construction material body is delimited. Spacers which support the reinforcement body 21 on the inner side of the former 22 can be omitted.

In accordance with the example all locations of engagement 56 extend in a common plane E. Depending on the positioning of the holding part 31 in the vertical direction H, the position and orientation of the reinforcement body 21 within the formwork 22 can be defined. In the exemplary embodiment shown here, the plane E is oriented substantially parallel to the contact face 28 and for example can extend horizontally.

Following the positioning and orientation of the reinforcement body 21 in the formwork 22, a flowable construction material B can be introduced into the interior of the formwork 22 (FIG. 4). The construction material B covers the reinforcement body 21 in the vertical direction H above and below (FIG. 5). Once the construction material B has been poured, it can be distributed uniformly in the formwork 22 by shaking or other measures. As soon as the pouring and distribution of the construction material in the formwork 22 is complete, the positioning device 20 can be removed. To this end, a switchover movement of holding parts 31 of the first holding part group 29 into the release position II is caused by actuation via the actuation device 46 (FIG. 6). The positioning device can then be raised on the side with the first holding part group 29 (FIG. 7). At the same time or subsequently, the positioning device 20 is moved parallel to the longitudinal direction L, such that the holding parts 31 or hooks 39 of the second holding part group 30 are disengaged from the reinforcement body 21. Lastly, the positioning device 20 can be removed from the formwork 22.

The reinforcement body 21 formed by the textile reinforcement does not sink in the state in which the construction material B is not yet hardened, not even if the positioning device 20 is removed before the hardening. The construction material B can thus enclose the reinforcement body 21 on all sides without visible spacers or fixing means. It is essential here that the later visible side of the produced construction material body, which is associated with the base-side inner surface of the formwork 22, can be formed uniformly without interruptions that for example would be created by visible end faces of spacers.

In an alternative exemplary embodiment the positioning device 20 can remain arranged on the formwork 22 during the hardening of the construction material B and can hold the reinforcement body 21. In this variant the holding parts 31 in the hardened construction material B are fixed on the rear side opposite the visible side and protrude therefrom the construction material body. The holding parts 31 are in this exemplary embodiment severed from the hardened construction material B prior to the removal of the positioning device 20.

Figure 13:
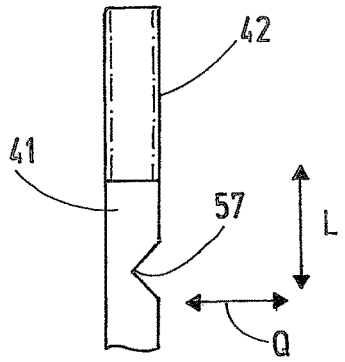
FIG. 13 shows a schematic, enlarged depiction of the predetermined breaking point from FIG. 12.

To this end it can be advantageous if the holding parts 31 and in accordance with the example the hooks 39 have a predetermined breaking point 57 (FIGS. 12 and 13). The predetermined breaking point 57 can be formed by a notching on the holding part 31. The position of the predetermined breaking point 57 is preferably arranged on the holding part 31 at the height corresponding to the rear side of the produced construction material body. The distance between the predetermined breaking point 57 and the middle of the curved working portion 40 of the hook 39 in the vertical direction H thus corresponds to the distance between the surface of the flowable construction material B poured into the formwork 22 from the reinforcement body 21. The predetermined breaking point 57 can be disposed in the attachment portion 41.

The notching or weakening of the holding part 31 is provided preferably in the transverse direction Q, such that a breaking of the holding parts 31 or hooks 39 by the generation of the tensile force F is avoided.

In the previously explained exemplary embodiment of the positioning device 20, the holding parts 31 of the second holding part group 30 are not movable by the actuation device 46. In contrast hereto, it is also possible to move all holding parts 31 in the event of a switchover movement between the holding position I and the release position II, or vice versa.

Figure 8:
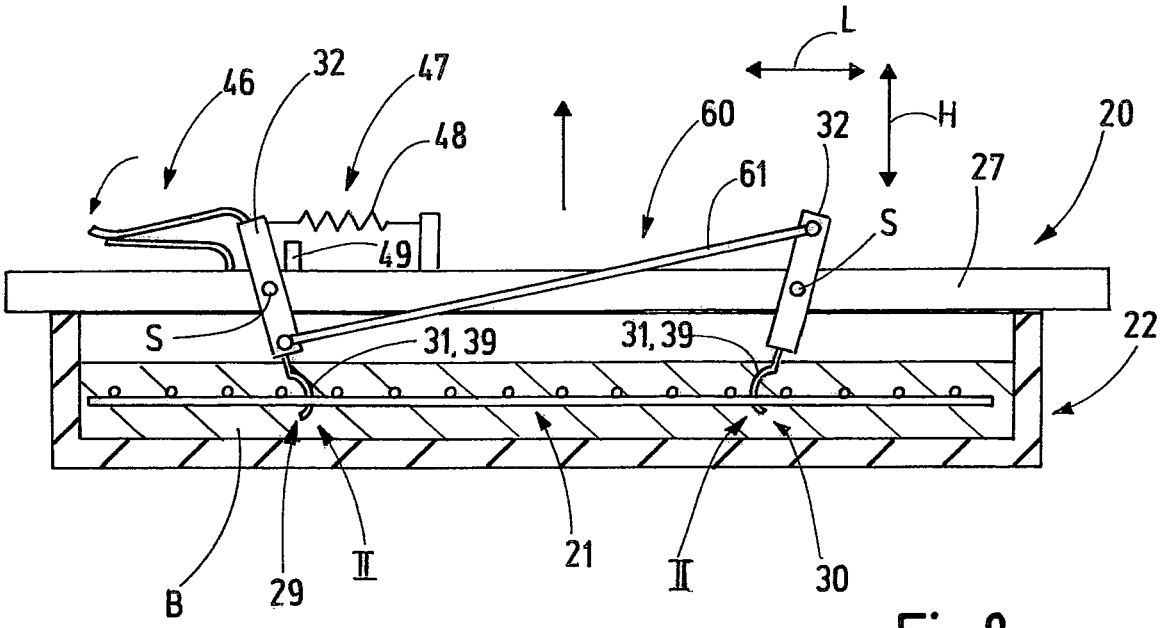
FIG. 8 shows a schematic side view of a modified exemplary embodiment of a positioning device and a cut formwork when producing a construction material body.

FIG. 8 shows an exemplary embodiment. Here, both supports 32 of both holding part groups 29, 30 are each mounted on the main body 27 so as to be pivotable about a pivot axis S extending in the transverse direction Q. The two supports 32 of the two holding part groups 29, 30 are coupled to one another in respect of their movement via a mechanical coupling device 60, in accordance with the example a coupling rod 61. When the actuation device 46 is actuated in order to move the holding parts 31 from the holding position I into the release position II, both supports 32 are pivoted and the respective holding parts 31 are moved towards one another.

In FIG. 8 the pivot position of the support 32 in the release position II is shown. As a result of the coupling of the two supports 32, all holding parts 31 or hooks 39 move away from their prior location of engagement 56, such that the removal of the positioning device 20 from the reinforcement body 21 is simplified, without any change to their orientation or position within the construction material B, which is still flowable. The positioning device 20 can preferably be removed by a movement in the vertical direction H, as is indicated by the arrow in FIG. 8.

In order to position a larger reinforcement body 21 within a formwork 22, a number of separate positioning devices 20 can also be used.

Figure 9:
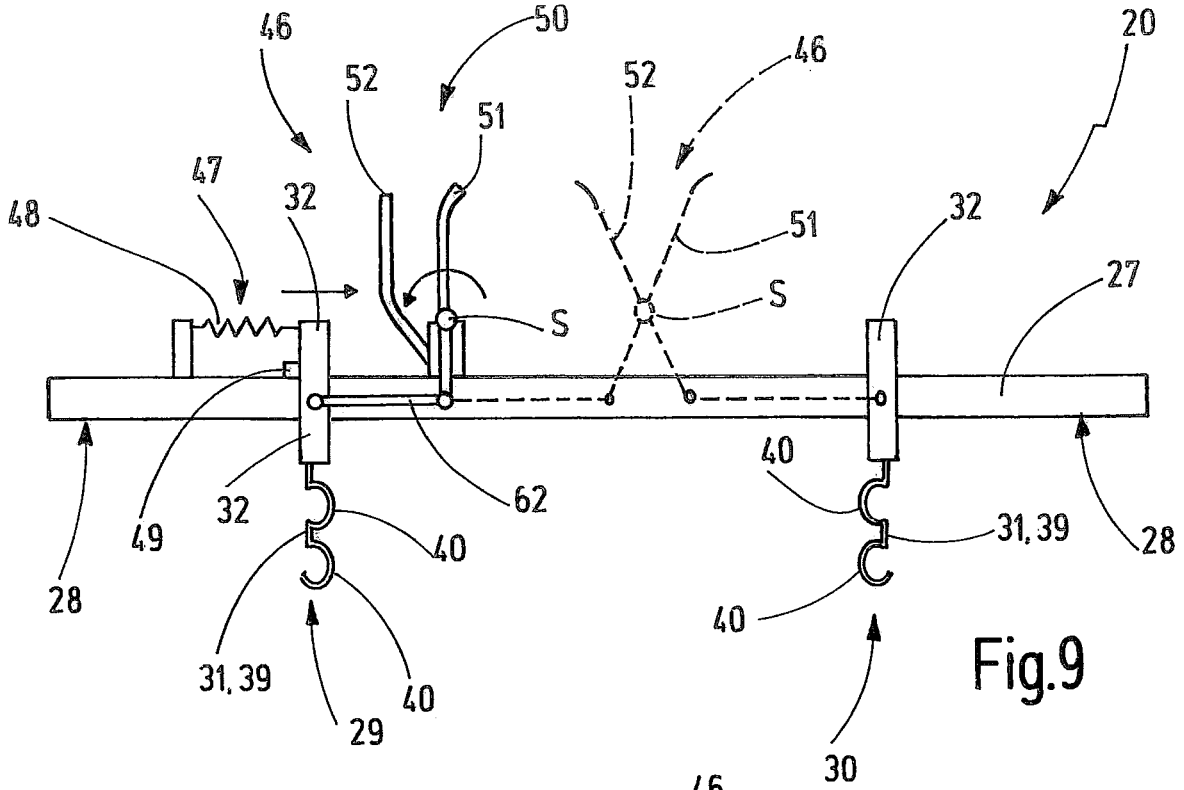
FIG. 9 shows a schematic side view of an exemplary embodiment of a positioning device in which a plurality of grid bodies can be held adjacently to one another.

Instead of the pivoting of the holding parts 31 in order to carry out the switchover movement between the holding position I and the release position II, the holding parts 31 or the relevant support 32 can also be moved parallel to the longitudinal direction L. An exemplary embodiment for this is shown in FIG. 9. There, the first grip part 51 is mounted about a pivot axis S extending in the transverse direction Q and is connected on the other side with respect to the pivot axis S via a connecting rod 62 to the support 32 of the holding parts 31 of the first holding part group 29. The support 32 of the first holding part group 29 is mounted on the main body 27 so as to be displaceable in the longitudinal direction L. The pivot movement of the first grip part 51 is converted into a linear movement of the support 32 via the connecting rod 62, such that the support 32 can be displaced with the holding parts 31 along the main body 27 between the holding position I and the release position II. The pre-tensioning of the support 32 in the holding position I is provided by means of the pre-tensioning device 47, as in the other exemplary embodiments.

It goes without saying that in the exemplary embodiment according to FIG. 9 both supports 32 of both holding part groups 29, 30 can also be linearly displaceable. To this end, a separate actuation device 46 and a separate pre-tensioning device 47 can be provided for the movement. It is also possible to associate the actuation device 46 with both supports 32, wherein, instead of a single fixed second grip part 52, the second grip part 52 likewise is mounted movably about the pivot axis S and is connected via a further connecting rod 62 to the support 32 of the second holding part group 30 (shown by dashed lines in FIG. 9). A separate pre-tensioning device 47 can be associated with the second support 32.

FIG. 9 shows a further optional embodiment possibility. For example, each holding part 31 can be configured to hold a plurality of separate reinforcement bodies 21 not directly connected to one another. To this end, the holding part 31 for example can have two curved working portions 40 and thus two hook inner regions, which are arranged adjacently to one another in the vertical direction H. In this embodiment for example two reinforcement bodies 21 according to FIG. 2 in the form of reinforcement grids or reinforcement mats can be held approximately parallel to one another and positioned in the formwork 22.

Figure 10:
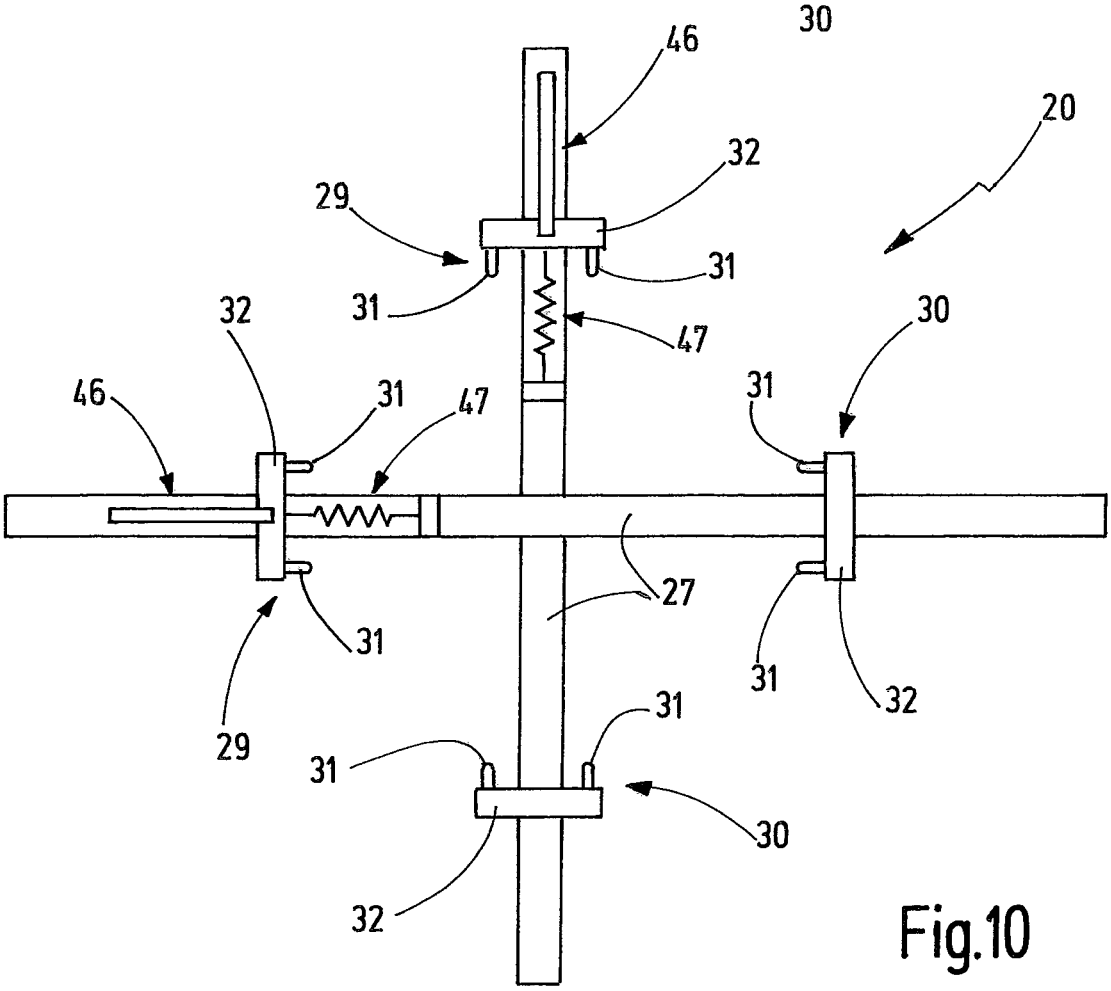
FIG. 10 shows an exemplary embodiment of a positioning device in a schematic plan view, which positioning device can exert tensile forces onto the reinforcement body in two spatial directions.

FIG. 10 shows, in a plan view, a heavily schematised exemplary embodiment of the positioning device 20, which consists so to speak of two of the previously described exemplary embodiments, which are arranged in a cross-shaped manner and the main bodies 27 of which are connected to one another at the crossing locations. In this way, a reinforcement body can be received and held such that tensile forces can be generated on the reinforcement body 21 in two directions oriented at right angles to one another. In the example shown in FIG. 10 two pairs formed in each case of a first holding part group 29 and a second holding part group 30 are provided and in each case are arranged opposite one another in a spatial direction along the bar-shaped main body 27. The number of pairs of holding part groups 29, 30 can vary in each spatial direction depending on the dimension of the reinforcement body 21 and can be selected accordingly.

Figure 14:
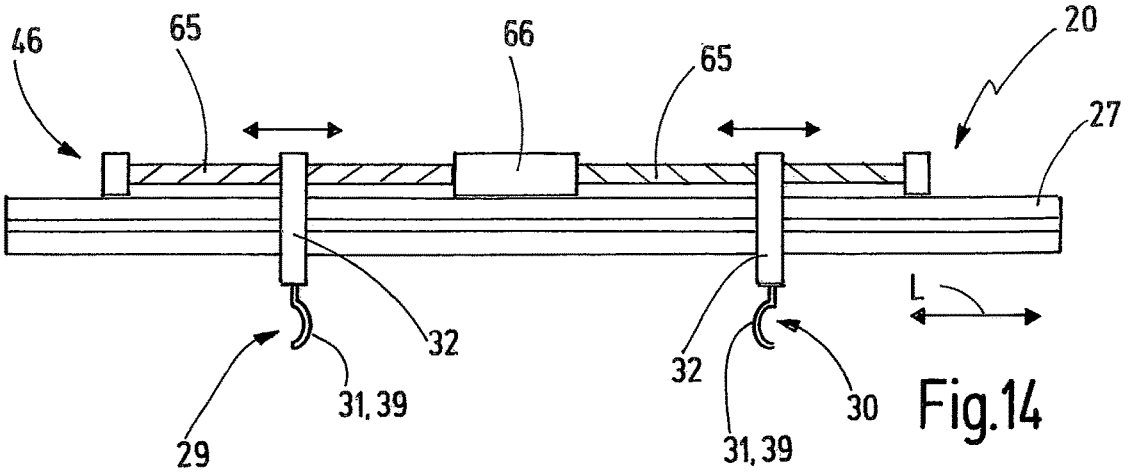
FIGS. 14 and 15 each show schematic depictions of exemplary embodiments of the positioning device configured for automatic or motor-driven actuation.
Figure 15:
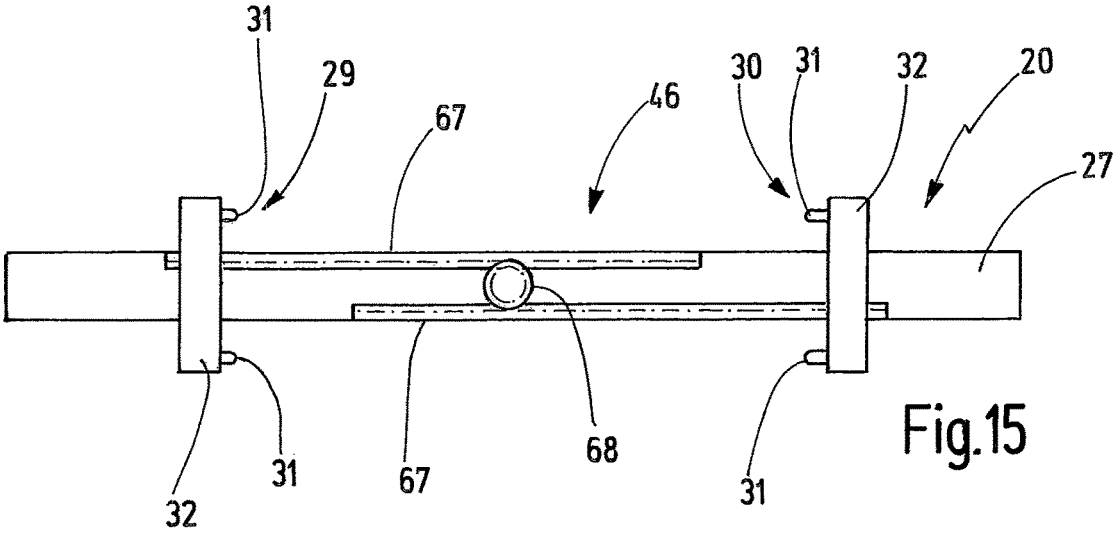

In accordance with the example, actuation devices 46 are shown in FIGS. 14 and 15, in which an automatable, motor-driven movement of the holding parts 31 of at least the first holding part group 29 or also both holding part groups 29, 30 for carrying out the switchover movement between the holding position I and the release position II is provided.

In the exemplary embodiment shown schematically in FIG. 14, the supports 32 of the two holding part groups 29, 30 are mounted linearly movably on the main body 27. Each support 27 is connected to a spindle nut or comprises a spindle nut, which sits on an associated drive spindle 65. By driving the drive spindles 65 about their respective axes of rotation, a linear movement of the relevant support 32 in the longitudinal direction L along the main body 27 is brought about. In accordance with the example the two drive spindles 65 are connected to a common drive motor 66 and have opposite thread pitches, such that the two supports 32 are moved in a direction towards one another when the drive motor 66 is rotated, and in the event of rotation in the opposite direction are moved away from one another. In contrast hereto, as in previously described exemplary embodiments, a support 32 could be arranged on the main body 27 so as to be immovable by the actuation device 46. A further modification is possible in that each drive spindle 65 is associated with a separate drive motor 66. The at least one drive motor 66 is preferably formed by an electric motor and/or is electrically controllable.

Instead of a drive motor 66, the actuation device 46 can be embodied passively so to speak, without its own motor-driven drive. To this end, the drive motor 66 in FIG. 14 could be replaced for example by a coupling device which can be coupled to a corresponding external drive motor in order to carry out the switchover movement between the holding position I and the release position II.

FIG. 15 shows an actuation device 46 without its own motor-driven drive. In this embodiment the holding parts 31, similarly to FIG. 14, are mounted on the main body 27 so as to be displaceable in the longitudinal direction L and are each connected to a toothed rack 67 extending in the longitudinal direction. Both toothed racks are engaged with a drive pinion 68 arranged therebetween. By rotating the drive pinion 68, the supports 32 of the two holding part groups 29, 30 can be moved towards one another or away from one another. A coupling device for connection to an external drive motor can be provided on the drive pinion 68. Alternatively to the shown exemplary embodiment it is also possible to arrange the drive motor on the main body 27 and to connect it to the drive pinion 68.

In a modification of the presented exemplary embodiments, many further drive types are possible. For example, belt drives can also be used in order to couple a drive pinion 68 or a drive motor 66 to the supports 32.

The invention relates to a positioning device 20 and a method for using the positioning device 20 when producing a construction material body made of a construction material B. The positioning device 20 is configured to hold a reinforcement body 21 preferably consisting of a textile reinforcement and to arrange and orient it by means of the positioning device 20 within a formwork 22. To this end the positioning device comprises a first holding part group 29 and a second holding part group 30, which are arranged on a main body 27. At least one of the two holding part groups 29, 30 is movable between a holding position I and a release position II, for example by a linear movement and/or a pivot movement. In the holding position I each holding part 31 acts on an associated location of engagement 56 on the reinforcement body 21. In the release position II the distance of the holding parts 31 from one another is different from the distance of the locations of engagement 56 on the reinforcement body 21, such that the positioning device 20 is brought into engagement with the reinforcement body 21 or can be removed from the reinforcement body 21. In the release position II an independent handling of the positioning device 20 relative to the reinforcement body 21 is made possible. In order to switch between the holding position I and the release position II, a manually actuatable and/or automatically actuatable actuation device 46 is provided.

LIST OF REFERENCE SIGNS

20 positioning device
21 reinforcement body
22 formwork
23 reinforcement element
27 main body

28 contact face
29 first holding part group
30 second holding part group
31 holding part
32 support
33 adjustment means
34 slot
35 bolt
39 hook
40 working portion
41 attachment portion
42 external thread
46 actuation device
47 pre-tensioning device
48 spring
49 first stop
50 handle
51 first grip part
52 second grip part
56 location of engagement
57 predetermined breaking point
60 coupling device
61 coupling rod
62 connecting rod
65 drive spindle
66 drive motor
67 toothed rack
68 drive pinion
I holding position
II release position
B construction material
E plane
F tensile force
S pivot axis

The invention claimed is:

1. A positioning device (20) for positioning a reinforcement body (21) having reinforcement elements (23) that cross one another in a formwork (22), the positioning device comprising:

a main body (27) that extends in a longitudinal direction, upon which at least one first holding part group (29) and at least one second holding part group (30) are arranged, wherein each of the first and second holding part groups (29, 30) comprise at least one holding part (31), and wherein the at least one holding part (31) of the first holding part group (29) is movable between a holding position (I) and a release position (II) using an actuation device (46), wherein in the holding position (I) the at least one holding parts (31) of the first and second holding part groups (29, 30) are configured to individually act on an associated reinforcement element (23) of the reinforcement elements of the reinforcement body (21) at a respective location of engagement (56) thereof, and wherein in the release position (II) the at least one holding parts (31) of the first and second holding part groups (29, 30) allow movement of the positioning device (20) relative to the reinforcement body (21), wherein in the holding position (I) the at least one holding parts (31) of the first and second holding part groups (30) are configured to generate a tensile force (F) on the reinforcement body (21) between the locations of engagement (56), wherein the at least one holding parts of the first and second holding part groups are each configured as a hook having a hook opening, and the hook openings face away from each other in opposite longitudinal directions when the hook of the first holding part group is in both of the holding and release positions, and the distance between the hooks is increased in the longitudinal direction when the hook of the first holding part group is shifted from the release position to the holding position.

2. The positioning device according to claim 1, wherein in the release position (II) the holding parts (31) of the first and second holding part groups (29, 30) are configured to not generate a tensile force (F) on the reinforcement body (21) between the locations of engagement (56).

3. The positioning device according to claim 1, wherein the at least one holding part (31) of the first holding part group (29) is positioned at a greater distance from the at least one holding part (31) of the second holding part group (30) in the holding position (I) than when in the release position (II).

4. The positioning device according to claim 1, wherein the holding parts (31) are arranged in such a way that the locations of engagement (56) in the holding position (II) are disposed in a common plane (E).

5. The positioning device according to claim 1, further comprising a contact face (28) on the main body (27) configured to be placed on an upper side of the formwork (22).

6. The positioning device according to claim 4, further comprising a contact face on the main body (27) configured to be placed on an upper side of the formwork (22), wherein the plane (E) is oriented in a predefined orientation relative to the contact face (28).

7. The positioning device according to claim 5, wherein the holding parts are individually connected to the main body with a moveable connection to allow the distance between the respective holding part (31) and the contact face (28) to be adjusted.

8. The positioning device according to claim 1, wherein individual ones of the holding parts (31) are arranged on the main body (27) so as to be movable by the actuation device (46).

9. The positioning device according to claim 1, wherein the at least one holding part (31) of the second holding part group (30) is arranged on the main body (27) so as to be immovable by the actuation device (46).

10. The positioning device according to claim 1, wherein the at least one holding part (31) of the first holding part group (29) is pre-tensioned in the holding position (I) using a pre-tensioning device (47).

11. The positioning device according to claim 1, wherein a plurality of holding parts (31) of the first holding part group (29) or second holding part group (30) are arranged on a common support (32), which is movably attached to the main body (27).

12. The positioning device according to claim 1, wherein the actuation device (46) comprises a handle (50) which is configured for manual actuation.

13. The positioning device according to claim 1, wherein the actuation device (46) comprises a drive part configured to be motor-driven.

14. The positioning device according to claim 1, further comprising an additional first holding part group (29) and an additional second holding part group (30).

15. The positioning device according to claim 1, wherein individual ones of the holding parts (31) have a predetermined breaking point (57).

16. A method for producing a reinforced construction material body with use of the positioning device (20) according to claim 1, the method comprising:

moving the at least one holding part (31) of the first holding part group (29) into the release position (II) using the actuation device (46), positioning individual ones of the holding parts (31) adjacently to or on the respective location of engagement (56) on the reinforcement body (21), moving the at least one holding part (31) of the first holding part group (29) into the holding position (I) using the actuation device (46), positioning the reinforcement body (21) held by the holding parts (31) in the formwork (22) using the positioning device (20), pouring a flowable construction material (B) into the formwork (22), hardening the construction material (B).

17. The method according to claim 16, further comprising, once the flowable construction material (B) has been poured and before the construction material (B) has hardened, performing:

moving the at least one holding part (31) of the first holding part group (29) using the actuation device (46) into the release position (II), and removing the positioning device (20) from the reinforcement body (21).

18. The method according to claim 16, further comprising, once the construction material (B) has hardened, performing:

severing the holding parts (31), and removing the positioning device (20) from the reinforcement body (21).

19. A positioning device (20) for positioning a reinforcement body (21) having reinforcement elements (23) that cross one another in a formwork (22), the positioning device comprising:

a main body (27), upon which at least one first holding part group (29) and at least one second holding part group (30) are arranged, wherein each of the first and second holding part groups (29, 30) comprise at least one holding part (31), and wherein the at least one holding part (31) of the first holding part group (29) is movable between a holding position (I) and a release position (II) using an actuation device (46), wherein in the holding position (I) the holding parts (31) of the first and second holding part groups (29, 30) are configured to individually act on an associated reinforcement element (23) of the reinforcement elements of the reinforcement body (21) at a respective location of engagement (56) thereof, wherein in the release position (II) the holding parts (31) of the first and second holding part groups (29, 30) allow movement of the positioning device (20) relative to the reinforcement body (21);

and wherein the at least one holding part (31) of the second holding part group (30) is arranged on the main body (27) so as to be immovable by the actuation device (46).

* * * * *